United States Patent [19]

Barnes et al.

[11] 4,176,796

[45] Dec. 4, 1979

[54] FEED DEVICE FOR SHEET GRANULATOR AND METHOD OF FEEDING SAME

[75] Inventors: William Barnes, South Attleboro; Roy W. Gerstenberg, Norfolk; Gomer E. Kropa, North Reading, all of Mass.; Roland A. LeJeune, Cumberland, R.I.

[73] Assignee: Leesona Corporation, Warwick, R.I.

[21] Appl. No.: 882,210

[22] Filed: Feb. 27, 1978

[51] Int. Cl.[2] ..... B02C 18/22

[52] U.S. Cl. ..... 241/30; 226/199; 241/73; 241/222

[58] Field of Search ..... 226/5, 91, 199, 196; 271/272–274; 241/27, 30, 73, 186.3, 281, 222, 224, 225, 243

[56] References Cited

U.S. PATENT DOCUMENTS

| | | | |
|---|---|---|---|
| 1,826,891 | 10/1931 | Krogan | 241/225 |
| 4,028,779 | 6/1977 | Shah | 241/73 |

*Primary Examiner*—Mark Rosenbaum
*Attorney, Agent, or Firm*—Robert J. Doherty

[57] ABSTRACT

This invention relates to size reduction apparatus and particularly to a novel feed device thereof and method of feeding sheet material thereto. A first baffle is adapted to extend into the cutting chamber simultaneously towards the cutting rotor and a downstroke wall portion from which a bed knife is adapted to extend into cutting contact with knife means mounted on the rotor. Such construction, in effect, enables the simultaneous formation of a variable width sheet feed opening to the granulator as well as means for restraining a portion of already granulated material on the upstroke side of the rotor from contacting the sheet material as it is fed between the rotor and bed knife. A secondary baffle may in turn be disposed in contact with the first baffle so as to close a secondary or housing opening disposed between the first baffle and a pair of upwardly spaced feed rolls.

12 Claims, 2 Drawing Figures

FIG. 1
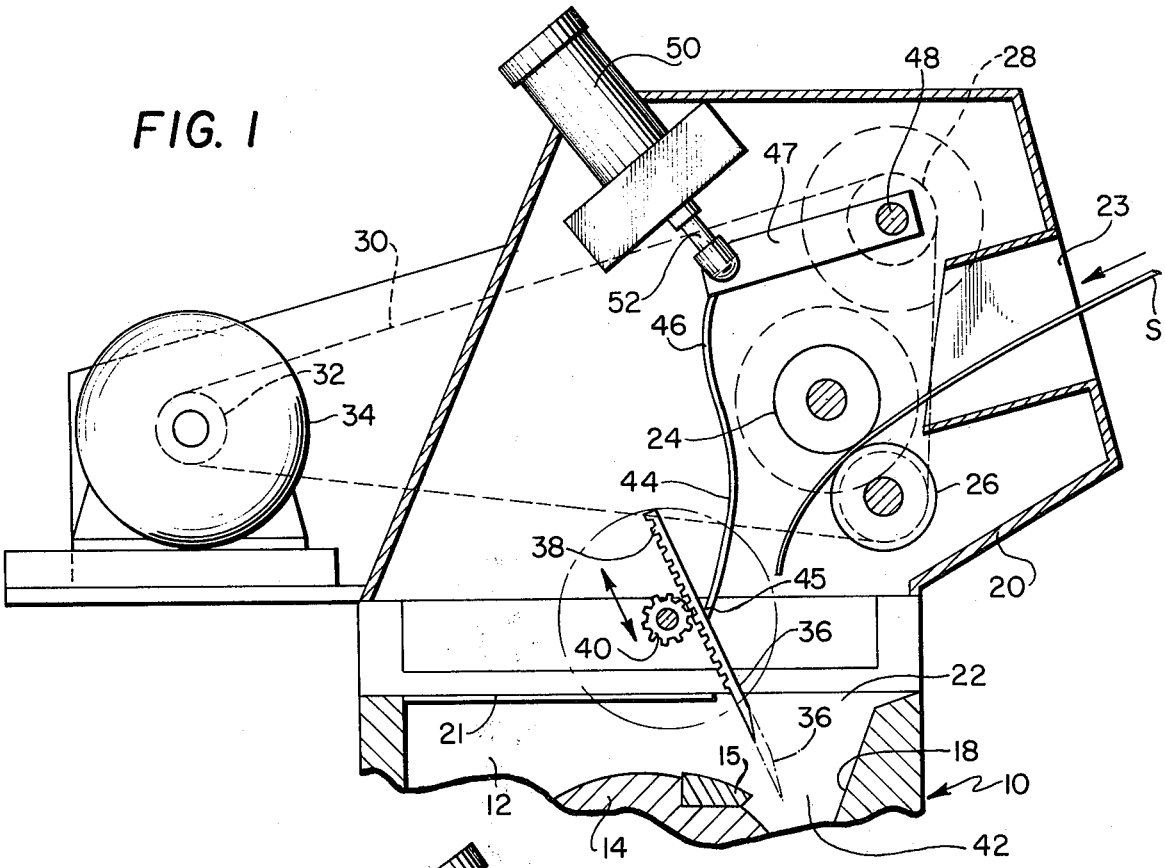
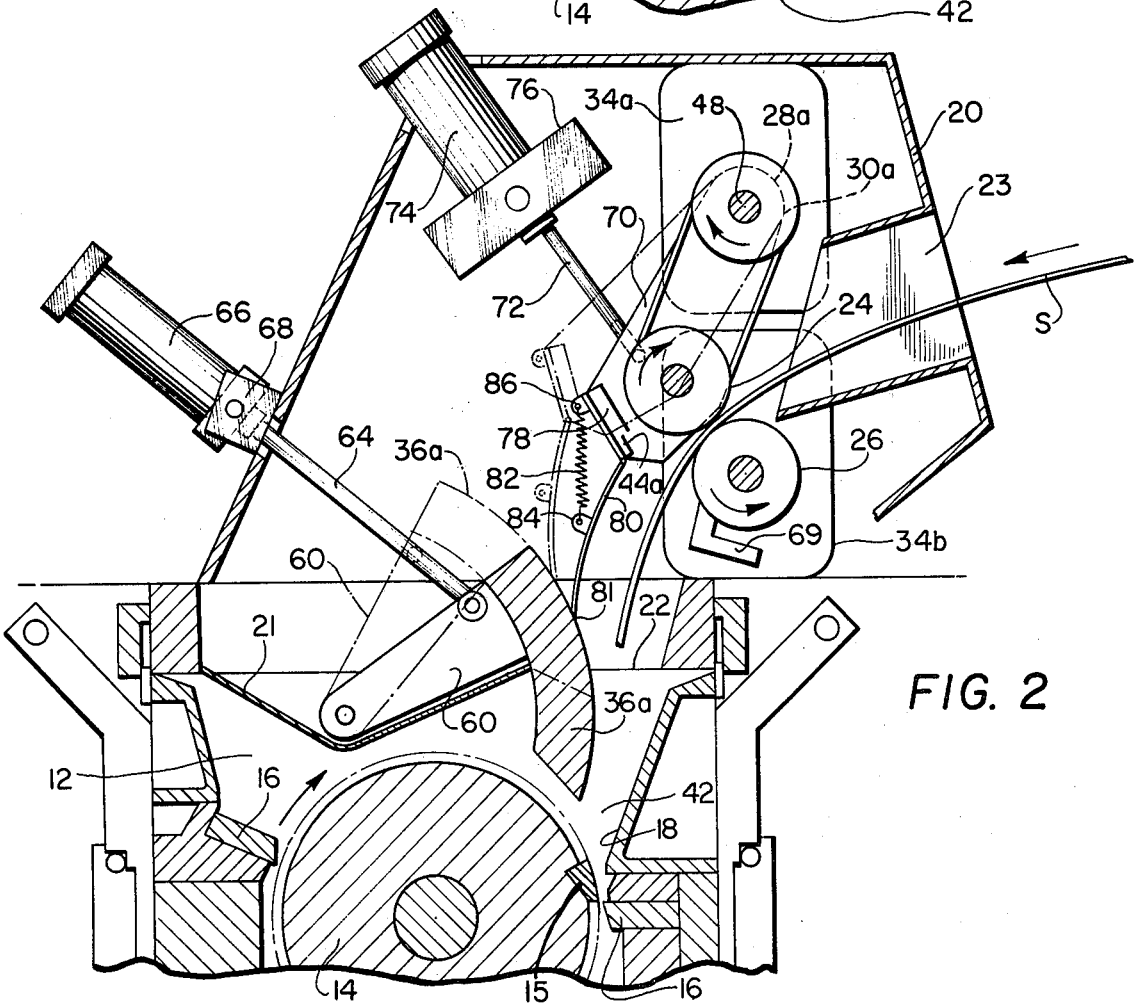
FIG. 2

FEED DEVICE FOR SHEET GRANULATOR AND METHOD OF FEEDING SAME

BACKGROUND OF THE INVENTION

This invention relates to a granulating device and method of granulating and more particularly to a sheet feeding apparatus associated with such granulator so as to accomplish improved operations as will hereinafter be indicated. In order to reprocess waste or off-specification sheet material, it is known to granulate such for subsequent reprocessing. In order to accomplish such, it is necessary that the sheet material be adequately fed to the granulation chamber in such a manner that it will not jam or be adversely affected by the movement of already partially granulated material within the chamber. In that regard, a feed device in the form of a baffle movable towards and away from the rotor is known and shown in U.S. Pat. No. 4,028,779 issued June 14, 1977 to the assignee of the present application. In such patent, a baffle acts to deflect already partially granulated material in the granulation chamber from adversely contacting thin accordionable sheet material as it is fed to the chamber. Thus, partially granulated material in the form of fluff and the like, drawn along with the rotation of the rotor is deflected by the baffle and thus at least a portion of such material is prevented from possible adverse contact with the sheet. The apparatus and operational method disclosed herein is particularly suited for thin film-like materials, although has other utility as well.

On some occasions as when handling thicker and relatively more stiff sheet materials such as 2 to 4 mil biaxially orientated polyester film such as utilized in sound recording tape and the like, it is desirable to additionally provide a feed axis opening into the granulation chamber which is variable in dimension. This is particularly true when tears or splits of such material which may undulate in cross section configuration, be doubled or otherwise exhibit multiple folds prior to introduction into the granulating device.

It is accordingly an object of the present invention to provide a feeding device for association with a granulator of the type above indicated which simultaneously provides a variable feed opening for sheet material being fed thereto and means for deflecting partially granulated material already in said chamber from adverse contact with said sheet material as it is fed to the granulator.

A still further object of the present invention is the provision of the device of the aforementioned type in which feed rolls are mounted above and spaced from said means and that the space formed therebetween it blocked by secondary means so as to insure movement of the sheet material into the feed opening.

Another object of the present invention is the provision of a method of feeding a granulation device of the immediately aforementioned type in which jam ups are reduced yet assuring high speed efficient operation.

These and other objects of the present invention are accomplished by the provision of a primary baffle extending into the granulation chamber and movable simultaneously towards and away from both the rotor and a wall portion disposed on the rotor downstroke chamber side so as to simultaneously vary both the feed opening and the effective deflection of already granulated material being moved by means of the rotor towards the feed opening. In a preferred embodiment of the present invention, the baffle is arcuately shaped and pivotally movable towards and away from both the rotor and the downstroke wall portion spaced therefrom and in either embodiment, a secondary baffle may be utilized to prevent material being fed into the chamber from initially being improperly directed into a supportive housing for said feed rolls and said baffle.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a partial side elevational view partially in section showing one form of the present invention; and FIG. 2 is a similar view of another form of the present invention.

DESCRIPTION OF THE INVENTION

Turning now to the drawing, FIG. 1 shows a construction of the present invention in its most essential or perhaps simplest form while FIG. 2 shows a modified and more complex constructional embodiment thereof. In both cases, feed means are associated with a granulator 10 of the type having a chamber 12 in which a rotor 14 is rotationally mounted. The rotor includes a plurality of knives (15) outwardly projecting from the periphery thereof. The rotor is axially, i.e. longitudinally mounted for rotation in the direction of the arrow wherein the knives thereof are positioned for cooperating cutting relationship with one or more fixed position bed knives 16. Although several such bed knives may be cooperatively mounted, at least one thereof is mounted so as to project into the chamber from a portion of a downstroke wall 18 disposed in and in part defining the upper downstroke quadrant of said chamber. The lower part of the chamber 12 includes a screen (not shown) having openings of a predetermined size so that material fed into the chamber and comminuted by the cooperative action of the above indicated knives will, once having been reduced to such predetermined size, pass through the openings therein and accordingly discharge from the chamber for further processing.

The terms upper and lower as used herein refer respectively to those positions above and below a horizontal plane passing through the rotational axis of the rotor. The terms upstroke and downstroke similarly respectively refer to those positions on either side of a vertical plane passing through the rotational axis of the rotor. Obviously, the terms horizontal and vertical as used herein are also relative and thus dependent on the particular orientation of the granulator 10 in use. Although normal horizontal orientation with respect to a ground base is contemplated, other orientations are not precluded.

The granulator as shown in FIG. 1 includes a housing 20 mounted on top thereof in such a fashion that interior portions of the housing are in communication with the chamber 12 although such communication may be partially removed by providing a chamber top 21 so as to define a slot 22 therebetween. The housing 20 further includes a feed opening 23 through sheet material S may be fed into the chamber 12 by a pair of feed rolls radially outwardly disposed of said feed opening and including an upper feed roll 24 and a lower driven feed roll 26. A drive wheel 28 is also provided as is a drive belt 30 trained over the drive wheel 28 and driven wheel 26 and drive pulley 32 of a motor 34.

A primary baffle 36 in the form of an elongated member having a rack means 38 formed in the base thereof, is positioned with respect to the housing 20 for movement into and out of the chamber 12 by a pinion gear 40. Suitable means for mounting the pinion gear as well as the baffle 36 are provided. At least the forward end of the primary baffle 36 is disposed in the upper downstroke quadrant of the chamber and is adapted to move not only towards the periphery of the rotor 14, but further simultaneously towards the downstroke wall 18 of the chamber. This effectively enables the baffle 36 not only to effectively function as a baffle and accordingly limit a portion of the already granulated material from contacting the incoming sheet material S, but additionally and simultaneously serves to vary a chamber feed opening portion 42 located below the chamber slot 22 so as to accommodate the movement therepast of various thicknesses of sheet material being fed. Such latter action is particularly desirable in cases where relatively thick or otherwise stiff sheet materials are fed into the granulator and when such sheets are not adequately downwardly deflected by means of the feed rolls so as to be properly received into the feed opening 42. In such cases, the primary baffle may be withdrawn to its uppermost position to provide a greater extent to such feed opening 42. It should also be pointed out that the movement of the baffle towards and away from the rotor 14 not only reduces undesirable deflection of the incoming sheet material from already granulated materials such as fluff being carried with the rotational movement of the rotor on the upstroke side thereof, but further produces a back pressure and resultant frictional heat buildup in the material being processed which is desirable in some cases.

In addition to the primary baffle 36 a secondary baffle 44 is disposed within that space between the primary baffle 36 and the feed rolls 24, 26. The secondary baffle 44 may be of a suitable width to span such opening and be formed of a stiff yet resilient material. Its terminal end 45 is additionally adapted to contact the upper surface of the baffle 36 during the movement of such primary baffle between the above described operational positions thereof. The upper end 46 of the secondary baffle 44 is suitably connected to a lever arm 47 in turn pivotally connected to a shaft 48 outwardly extending from the drive roll 28. A cylinder 50 having a reciprocating piston 52 is in turn connected to the arm 47 so as to position the secondary baffle 44 with respect to the primary baffle 36 depending on the latter's movement relative to the chamber 12. Furthermore, means (not shown) for actuating the pinion 40 and thus carry out the above-described movement of the primary baffle 36 is further included.

Turning now to the embodiment shown in FIG. 2 of the drawing, it may be seen that the top plate 21 is downwardly inwardly directed with respect to the chamber and rotor so as to in part form a material restriction between it and the periphery of the rotor 14 and to also provide an axis for a pivot arm 60 on which an arcuately shaped primary baffle **36*a* is mounted. The pivot arm 60 is in turn connected to the reciprocating piston 64 of a cylinder 66 suitably connected to the housing 20 by means of a mount 68. Accordingly, the primary baffle 36*a* is adapted to move in and out of the slot 22 and simultaneously towards the periphery of the rotor 14 and the downstroke wall 18 of the chamber 12. The extent of such reciprocation is shown by the dotted and full line representation in FIG. 2** although modified travel to suit particular purposes may be utilized.

A modified form of driving means for the feed rolls 24, 26 is also shown in the FIG. 2 embodiment wherein a drive belt **30*a* is trained over the drive wheel 28*a* and the driven roll 24. The roll 28*a* may be driven by a motor 34*a*. Roll 26 may be additionally driven by a motor 34*b*. An antiwrap device 69 such as the knife edge shown may be also utilized in this embodiment as well as in that shown in FIG. 1**.

A pair of longitudinally spaced plates 70 are pivotally suspended from shaft 48 similar to the mounting of the pivot arm 47 in the embodiment shown in FIG. 1. Such plates downwardly extend and terminate below the drive rolls 24 in the space between such drive rolls and the outer convex surface of the primary baffle **36*a*. Such plates 70 may be pivotally swung between the positions depicted in the solid and phantom line representations by means of a reciprocating piston 72 of a cylinder 74 also suitably connected to the housing 20 as by mounting means 76. The lower terminal end of the arm 70 supports a modified form secondary baffle 44*a* in turn having a mounting boss 78 attached thereto. The secondary baffle is segmented and includes a pivotal segment 80 having a terminal portion 81 adapted to continually engage the outer convex surface of the primary baffle 36*a*. Such continual contact is accomplished by a spring 82 suitably connecting to the mounting block 78 with the segment 80 by means of a pair of ears 84, 86. Thus, not only does the secondary baffle in those cases where the sheet material being fed is relatively stiff, serve to initially deflect the entering sheet material down into the variable dimension feed opening 42, but additionally serves to prevent material fluff from entering into the interior extent of the housing 20 and interferring with the operation of the various feed roll components as by contamination of the bearings and other moving parts thereof. The modified form secondary baffle 44*a* has equal utility with the primary baffle construction shown in the FIG. 1** embodiment.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In combination with a granulator for size reduction of material, a feeding device for feeding sheet material thereto, said granulator having walls defining a generally enclosed chamber including an upper wall, a rotor mounted for rotation about an axis within said chamber, cutting means affixed on said rotor, bed knife means mounted for projection into said chamber on the rotor downstroke side thereof for cooperative cutting relationship with said cutting means as said rotor is driven, a downstroke wall generally disposed in the chamber and in a quadrant thereof disposed above the horizontal axis of said rotor and on the downstroke side of the vertical axis thereof, said feeding device comprising a primary baffle disposed generally centrally above said rotor and having portions thereof proximate said downstroke wall, at least said portions disposed in said chamber quadrant and below said upper wall, means moving said baffle in said chamber towards and away from said downstroke wall thereof so as to define a variable dimension feed opening for said sheet material between opposed surfaces of said portion of said baffle and said downstroke wall, and means for feeding sheet material into said feed opening, said feeding means disposed in a position radially outwardly of those portions of said primary baffle and said downstroke wall forming said feed opening with respect to said rotor, said primary baffle further simultaneously respectively movable towards and away from said rotor so as to respectively increase and decrease the back pressure in said chamber and to deflect already granulated material from contacting said sheet.

2. The device of claim 1, including a generally enclosed housing mounted about and communicating with said chamber, said primary baffle and said sheet feeding means mounted in said housing.

3. The device of claim 2, said sheet feeding means spaced from said baffle so as to form a secondary opening therebetween and a secondary baffle mounted in said housing so as to close said secondary opening, said secondary baffle adapted to continually contact said primary baffle as said primary baffle moves within the confines of said feed opening.

4. The device of claim 3, said axis being longitudinally orientated, said chamber having a top wall generally separating said chamber from said housing except for a slot therein, said slot longitudinally extending along the downstroke side of said chamber, said primary baffle adapted to extend through said slot.

5. The device of claim 4, said primary baffle being mounted for pivotal movement with respect to said feed opening.

6. The device of claim 5, said primary baffle of an overall arcuate shape having its convex side disposed towards said downstroke wall and pivotally movable into and out of said slot.

7. The device of claim 4, said secondary baffle being segmented and including a wiper segment spring urged into sealing contact with said primary baffle.

8. The device of claim 4, arm means pivotally mounted with respect to said housing, said arm means in turn supporting said secondary baffle.

9. The device of claim 8, said means for feeding said sheet material being a pair of feed rolls, the upper one of said rolls being in turn belt driven by a drive roll, said arm means pivotally mounted to the axis of said drive roll.

10. The device of claim 1, said primary baffle being of relatively straight configuration, said means for moving said baffle being a rack and pinion.

11. The method of granulating sheet material in a granulator having walls defining a generally enclosed chamber including an upper wall, a rotor mounted for rotation about a longitudinal axis within said chamber, cutting means affixed on said rotor, bed knife means mounted for projection into said chamber from a rotor downstroke wall portion for cooperative cutting relationship with said cutting means as said rotor is driven, said downstroke wall generally disposed in the chamber and in a quadrant thereof disposed above the horizontal axis of said rotor and on the downstroke side of the vertical axis thereof, a primary baffle disposed generally centrally above said rotor and having portions thereof proximate said downstroke wall, at least said portions disposed in said chamber quadrant and below said upper wall, means for moving said primary baffle towards and away from said downstroke wall so as to define a variable dimension feed opening, feed means for directing sheet material into said feed opening, a housing positioned above said chamber, said primary baffle and said sheet feeding means mounted in said housing in spaced position from each other so as to form a secondary opening therebetween, said feeding means disposed in a position radially outwardly of those portions of said primary baffle and said downstroke wall forming said feed opening with respect to said rotor, and a secondary baffle opening, comprising, feeding relatively stiff sheet material into said housing initially towards said secondary baffle so as to sequentially contact said secondary and primary baffle and thereafter directing said sheet into said feed opening for subsequent size reduction within said chamber.

12. The method of claim 11, including at least partially filling said chamber with partially granulated material and thereafter moving said primary baffle simultaneously towards said rotor so as to deflect upstroke partially granulated material away from contact with said sheet material being fed to said chamber.

* * * * *